US006264133B1

(12) United States Patent
Herrmann

(10) Patent No.: US 6,264,133 B1
(45) Date of Patent: Jul. 24, 2001

(54) DEVICE FOR EXCHANGING ROLL SUPPORTS ON WINDING STATIONS

(75) Inventor: Rudolf Herrmann, Adetswil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/259,693

(22) Filed: Mar. 1, 1999

(30) Foreign Application Priority Data

Mar. 4, 1998 (CH) ..... 517/98

(51) Int. Cl.[7] ..... B65H 19/00

(52) U.S. Cl. ..... 242/559.3; 242/528; 242/533.2; 242/533.7

(58) Field of Search ..... 242/559, 559.3, 242/559.4, 560, 561, 528, 533.2, 533.7

(56) References Cited

U.S. PATENT DOCUMENTS

| | | | | |
|---|---|---|---|---|
| 4,587,790 | | 5/1986 | Muller . | |
| 4,676,496 | | 6/1987 | Honegger . | |
| 4,703,901 | | 11/1987 | Stauber . | |
| 4,752,176 | * | 6/1988 | Linder | 414/911 X |
| 4,768,768 | | 9/1988 | Reist . | |
| 4,807,350 | * | 2/1989 | Hasenkamp | 414/911 X |
| 5,007,522 | * | 4/1991 | Focke et al. | 414/911 X |
| 5,022,807 | * | 6/1991 | Linder | 414/911 X |
| 5,067,871 | * | 11/1991 | Hilber | 414/911 X |
| 5,161,933 | | 11/1992 | Stauber . | |
| 5,286,157 | * | 2/1994 | Vainio et al. | 414/911 X |
| 5,379,963 | | 1/1995 | Stauber . | |
| 5,398,883 | | 3/1995 | Stauber . | |

* cited by examiner

*Primary Examiner*—William A. Rivera
(74) *Attorney, Agent, or Firm*—Oppedahl & Larson LLP

(57) ABSTRACT

For intermediate storage, printed products are often wound onto winding cores mounted on roll supports (3) with a horizontal winding axis. After intermediate storage the printed products are unwound again. For winding-up and unwinding, a roll support (3) is positioned in a winding station and when winding-up or unwinding is complete the roll support (3) is replaced by another one. In order to serve an arrangement of winding stations (W) and storage positions (L) for roll supports (3) efficiently and possibly in a fully automated manner on as little space as possible and with an orientation of winding stations (W) and storage positions (L) substantially freely adaptable to given conditions, a manipulator (1) is used for manipulation and transport of the roll supports (3). This manipulator is movable in x-, y-, and z-directions and rotatable around a vertical rotation axis. It includes at least two coupling part (2) arranged around the vertical rotation axis with an angle of 90° between them. The manipulator-coupling-part (2) can each be coupled to an additional coupling part (2') arranged on the rear narrow side of each roll support (3). For an exchange of roll supports, the manipulator (1), to which a roll support (3) is coupled, is moved to the winding station (W) such that the roll support (3) to be replaced can be coupled to the second coupling part (2) of the manipulator. Then the roll support (3) is removed from the winding station (W), the manipulator (1) is rotated by 90° in order to orient the other roll support to the winding station (W), the other roll support (3) is introduced into the winding station (W) and is de-coupled. Then the manipulator (1) is withdrawn together with the removed roll support.

9 Claims, 4 Drawing Sheets

DEVICE FOR EXCHANGING ROLL SUPPORTS ON WINDING STATIONS

The invention is in the field of processing flexible, flat objects, in particular printed products, and it concerns a device according to the generic part of the first, independent claim. The device serves for exchanging supports for rolls of printed products on winding stations and for transporting roll supports to or from winding stations or in general it serves for manipulating and transporting roll supports.

In the printing industry, it is known to wind up printed products and/or product parts for intermediate storage or for transport over larger distances. The products are wound in scaled formation on a winding core with the aid of a winding tape, the products are transported and/or stored intermediately as rolls and the scaled formation is unwound again for further processing. For winding-up and for un-winding, corresponding winding stations are used. A scaled stream of products and empty winding cores are supplied to winding-up stations and are conveyed away from un-winding stations. Rolls are removed from winding-up stations and are supplied to un-winding stations.

The rolls to be supplied and to be removed to and from winding stations usually have a diameter in the range of two meters and a weight in the range of one ton. The axial width of such rolls is somewhat larger than the width of the wound up products which is e.g. 30 to 50 cm.

In the manipulating and transporting steps necessary for the above mentioned functions either rolls or empty winding cores are manipulated and transported substantially without the aid of further means, as is e.g. described in the publications EP-527702 (or U.S. Pat. No. 5,379,963) and EP-505320 (or U.S. Pat. No. 5,398,883). However, it is possible also to manipulate and transport roll supports (also called winding cassettes) which either carry a roll or an empty winding core, as is e.g. described in the publications EP-333648 (or U.S. Pat. No. 5,161,933) and EP-243837 (or U.S. Pat. No. 4,768,768).

These roll supports are usually simple, mobile, frequently passively movable devices on which a winding core is mounted rotatable around a horizontal winding axis. Such devices frequently also comprise devices for winding-up and for un-winding a winding tape. An empty roll support comprises an empty winding core (no products wound on it), an occupied roll support carries a scaled formation of printed products wound onto the winding core. The roll support is positioned in a correspondingly equipped winding station and is usually adapted to the winding station such that a wound-up scaled formation carried by the roll support is unwound directly in an un-winding station or such that a scaled formation supplied to a winding-up station is wound directly onto the winding core of a roll support.

Roll supports as described above are described in the publications DE-3236866 (or U.S. Pat. No. 4,587,790), EP-0149058 (or U.S. Pat. No. 4,676,496) or EP-0242607 (or U.S. Pat. No. 4,703,901).

For reasons regarding space, the roll supports are advantageously designed such that the horizontal projection of a roll support is as little larger as possible than the horizontal projection of the roll positioned on it. Again for reasons regarding space, the winding stations are mostly designed such that the roll supports can be brought into their winding position in a direction perpendicular to the winding axis through an entrance of the winding station and that they can be removed from the winding station in the opposite direction. Thereby, the winding direction for the winding-up or for the un-winding is always the same and generally identical for all winding stations of one installation. Therefore, the orientation of the roll support in the winding station needs to be always the same also. Again for reasons regarding space, the winding stations are usually arranged coaxially in a line such that the faces of rolls being wound-up or un-wound are in parallel and such that the rolls can be introduced and removed perpendicular to the winding axis.

Roll supports in winding stations or storage positions are e.g. manipulated and transported by being coupled to suitable vehicles or by being raised by the loading fork of a vehicle. Because with such manipulation/transport methods, normally only one roll support can be gripped and moved at one time many shunting steps are necessary near a winding station in which the roll supports are to be exchanged. For these shunting steps as well as for transport paths a lot of space must be provided. Furthermore, this kind of method is not suitable for a high degree of automation and is rather slow. However, it has the advantage of imposing hardly any conditions on the spatial orientation of winding stations and for storage positions for roll supports.

It is, however, a known fact that in new factory buildings, space is expensive and in existing factory buildings, is only restrictedly available. In particular in the case of extensions, it is a fact also that the space available for one predetermined function could be taken better advantage of if correspondingly flexible installations were provided, i.e. installations which can be better adapted to the form of the available space.

Considering the named facts, the object of the invention is to create a device for exchanging roll supports on winding stations or more in general for manipulating and transporting roll supports, which device on the one hand is applicable and efficiently operated in the same manner as the vehicles mentioned above, which device, however, requires considerably less shunting space such that winding stations and storage positions can be arranged as densely as possible in spaces of the most various forms. Furthermore, the device is to be completely automatable and is to be producible using known components to a high degree.

This object is achieved by the device as defined in the independent claim. The dependent claims define advantageous embodiments of the inventive device.

The inventive device substantially consists of a manipulator travelling in x-, y- and z-direction and being equipped with at least two coupling means which cooperate with coupling means arranged on the roll supports. For manipulating and transporting a roll support, its coupling means is coupled to one of the manipulator-coupling-means. The at least two manipulator-coupling-means are arranged set off from each other by 90° in relation to a vertical axis and the manipulator is pivotable around this axis (e.g. by 90°) such that by rotating the manipulator, it is possible to bring the one coupling means into the position occupied before by the other one. Each roll support has one coupling means arranged on the rear one of its two narrow sides which are substantially parallel to the winding axis, i.e. on the one narrow side which faces the entrance of the winding station when the roll support is positioned in the winding position.

The manipulator with a first roll support coupled to its one coupling means is brought into coupling position relative to its other coupling means and to the coupling means of a second roll support positioned in a winding station by being rotated and/or displaced in x-, y- and/or z-direction such that the second roll support can be coupled to the manipulator. After coupling, the manipulator is displaced perpendicular to the winding axis of the newly coupled second roll support (in a horizontal, vertical or sloping direction), such that the second roll support is removed from the winding station. Then, the manipulator is rotated by 90° such that the first roll support to be supplied to the winding station has the same position as the second roll support withdrawn from the winding station had beforehand. Then, the withdrawing movement is reversed for inserting the first roll support into the winding station (inserting movement). The newly inserted first roll support is then de-coupled from the manipulator and the manipulator is removed together with the second roll support.

For preventing unnecessary acceleration and deceleration of the mass constituted by roll and roll support when being transported and manipulated it is advantageous to design the manipulator such that it is able to carry out movements in x-, y- and z-directions and, if necessary, rotation movements simultaneously. This kind of simultaneousness also results in a more efficient operation.

For exchanging roll supports in storage positions, about the same succession of movements as described above for the winding station is carried out. Because the roll supports only have coupling means on one of their narrow sides they cannot be passed from one manipulator to another. This, however, guarantees that for any arrangement of winding stations and in every case, the roll support is introduced into the winding station correctly (rear narrow side facing towards the entrance side of the winding station), independent of how many times it has been introduced and removed previously.

The inventive device is described in more detail in connection with the following Figures, whereby FIG. 1 shows a roll exchange on a winding station with the help of the inventive device;

Figure 1:
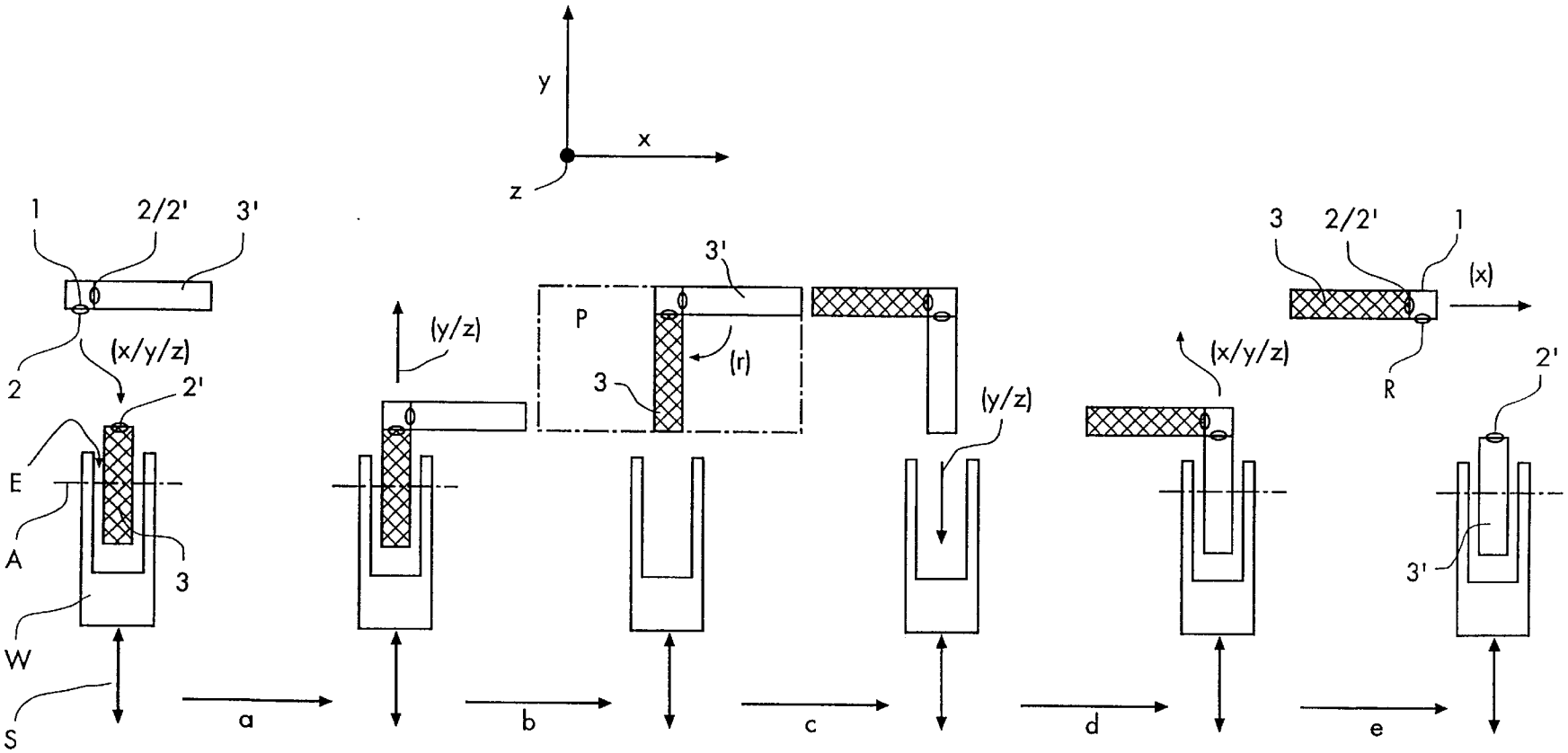

FIG. 1 shows in a schematic bird's eye view of the method for replacing an e.g. full roll support 3 by an e.g. empty roll support 3' on a winding station W whereby the empty roll support is transported to the winding station by the inventive device and the full roll support is removed from it in the same manner. The winding station W has an entrance E through which a roll support is introduced into the winding station. On the winding station side opposite of the entrance E there is a scaled product stream being conveyed away from the winding station (un-winding station) or being supplied to the station (winding-up station). The scaled formation is shown diagrammatically by means of a double arrow.

The roll exchange comprises substantially five steps: (a) positioning and coupling, (b) removing, (c) rotating, (d) introducing, (e) de-coupling and withdrawing. FIG. 1 shows the six positions of the manipulator 1 of the inventive device and the roll supports 3 and 3' to be exchanged before, between and after the above steps a to e. Furthermore, the movement to be carried out in the following step is indicated by means of an arrow in each phase.

The manipulator 1, shown diagrammatically in form of a square, comprises at least two coupling means 2, shown diagrammatically as ovals and arranged on the manipulator 1 such that after each other, they can be brought into an identical position by rotating the manipulator by e.g. 90° around a vertical axis. The roll supports 3 and 3' are shown diagrammatically as rectangles. They also comprise a coupling means 2' on their rear narrow sides (parallel to the winding axis A). The roll support to be removed from the winding station which is e.g. full is hatched and is denominated with reference number 3, the roll support to be introduced into the winding station which is e.g. empty is not hatched and is denominated with reference number 3'. Reference number 2/2' denominates manipulator-coupling-means 2 and support-coupling-means 2' being coupled. The coordinates x, y and z are chosen such that x and y are horizontal and z is vertical.

The manipulator with the empty roll support 3' coupled (2/2') to one of his coupling means is brought into a position (positioning) in which its other coupling means 2 can be coupled with the coupling means of the full roll support 3 positioned in the winding station W. This positioning may include displacement in x-, y- and/or z-direction and may also include rotation r of the manipulator around the vertical axis. The co-operating coupling means 2 and 2' are advantageously designed such that coupling is effected by positioning only (no additional movement of the manipulator).

In a second step b (removing) the full roll support 3 is removed from the winding station for which, in the shown case, movement of the manipulator in y direction is necessary. In a third step c (rotating) the manipulator to which two roll supports 3 and 3' are now coupled is rotated (r) by 90° such that the empty roll support 3' is brought into the position previously held by the full roll support 3, i.e. is directed towards the entrance E of the winding station W. In a fourth step d (introducing) the empty roll support 3' is introduced into the winding station. As soon as the empty roll support 3' is positioned in the winding station the coupling 2/2' is released and the manipulator to which now only the full roll support 3 is coupled is withdrawn, e.g. in x-, y- and/or z-direction (fifth step e, withdrawing).

A process in which e.g. an empty roll support in a storage position is replaced by a fill one comprises substantially the same steps as described for the exchange of one roll support by another one in a winding station W.

FIG. 1 shows that the manipulator 1 does not impose any condition on a plurality of winding stations (and also of storage positions for roll supports) to be served by the manipulator regarding their orientation in x- and y-directions and their position in z-direction. However, at the entrance side of the winding station W from where the roll supports are introduced and removed (entrance E), an area P (bordered with dash-dot-lines in the phase between steps b and c) is to be provided for allowing introduction or removal of a roll support with the aid of the manipulator 1 to which another roll support is coupled in one or the other transverse direction. The area P ("shunting area") necessary for this manipulator-movement is also sufficient for the rotation r.

The rolls are brought into the winding station W shown in FIG. 1 in a horizontal movement (y-direction) such that the shunting area P is located at the same level as the winding station. If the winding station (or a storage position) allows it, roll supports can also be introduced into or be removed from the winding station in a vertical movement or in a movement consisting of vertical and horizontal elements (in y- and z-direction). In such a case, the shunting area P is positioned above the winding station and may partly overlap the base of the winding station such having a lesser effect on floor space needs.

Figure 2:
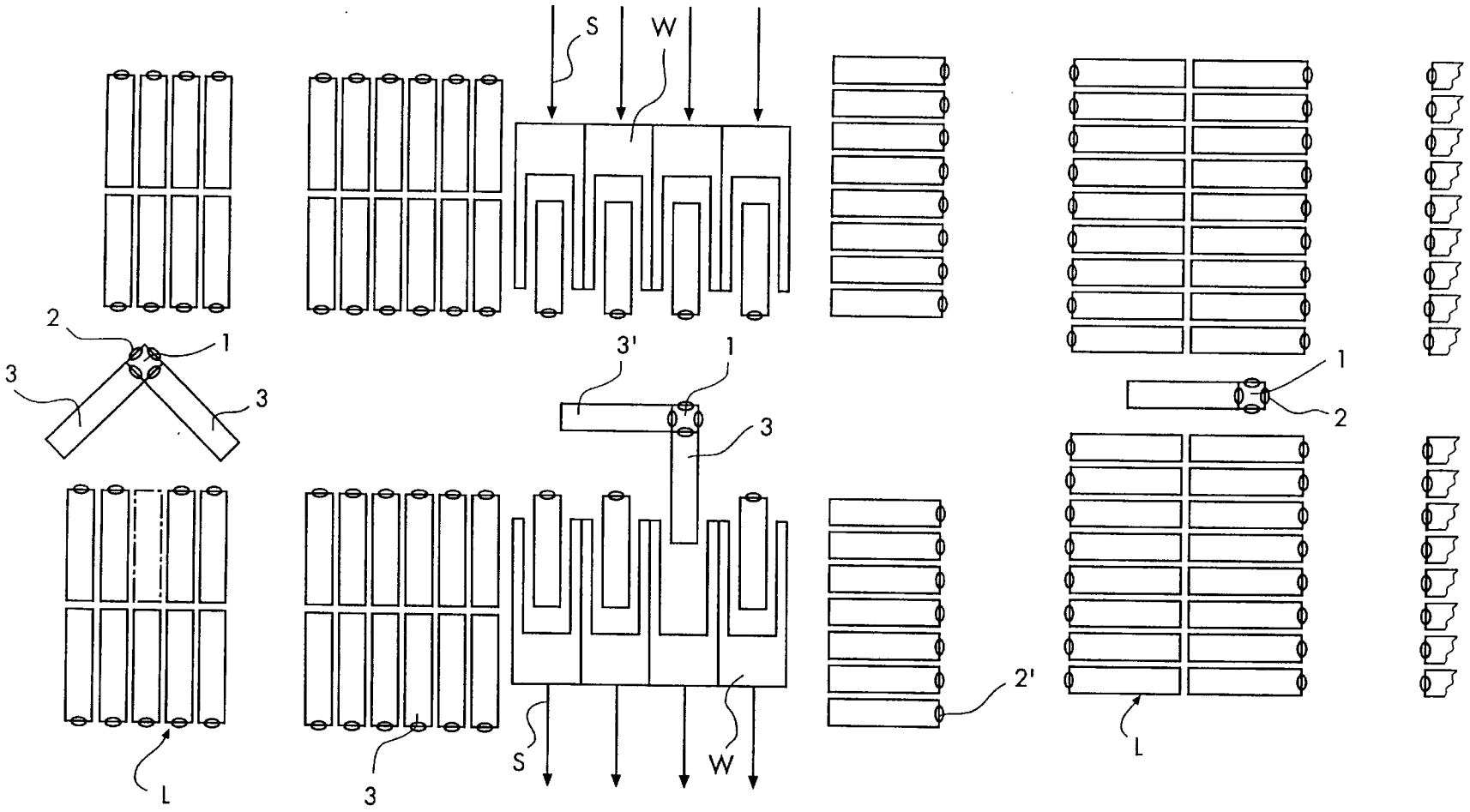
FIG. 2 shows an exemplified arrangement of winding stations and storage positions for roll supports served by a plurality of inventive devices.

FIG. 2 shows in a diagrammatic representation of substantially the same kind as used in FIG. 1, an exemplified arrangement of a plurality of winding stations W for winding scaled formations of printed products onto roll supports 3' or 3 or for unwinding them from roll supports and of storage positions L in which empty and full roll supports 3 and 3' are stored. All roll supports comprise coupling means 2' on their rear narrow side. The arrangement is served by e.g. three manipulators each comprising four coupling means 2 arranged around the vertical rotation axis with intermediate angles of 90°.

Two roll supports 3 are coupled to the manipulator 1 shown on the very left, and the manipulator is just bringing one of the roll supports 3/3' into a position by means of rotation from which position it can be introduced into the empty storage position shown with broken lines. The manipulator 1 shown between the winding stations W also carries two coupled roll supports 3/3' and is just introducing a roll support 3 into a winding station. The manipulator 1 shown on the right only carries one coupled roll support which it is transporting to a storage position or to a winding station. On this manipulator it can be seen how narrow and thus how space saving transport paths for the transport of roll supports with the help of the manipulator of the inventive device can be.

The installation according to FIG. 2 comprises, in exemplified manner, lines of winding stations and storage positions which are restricted to two directions (x and y) at right angles to each other. In this kind of installation, a manipulator rotatable in steps of 90° only can be used. Thus, the manipulator and its control is simplified but corresponding conditions are imposed on the arrangement of winding stations and storage positions. However, the degree of freedom for arranging winding stations W and storage positions L to be served by one or a plurality of manipulators 1 rotatable in steps of 90° is still considerable. In particular, it is possible to arrange winding stations W with e.g. similar directions for supplying and removing scaled product streams (arrows S), the winding stations being arranged on two sides of the same operation corridor and storage positions with wider manipulation corridors and narrower transport corridors which can be orientated in two directions.

As FIG. 2 is a top view it cannot make a statement about the vertical arrangement of the winding stations and the storage positions. As the manipulator is also movable in z-direction (vertical direction) the storage positions may comprise several stories and storage positions can be arranged above or below winding stations.

Figure 3:
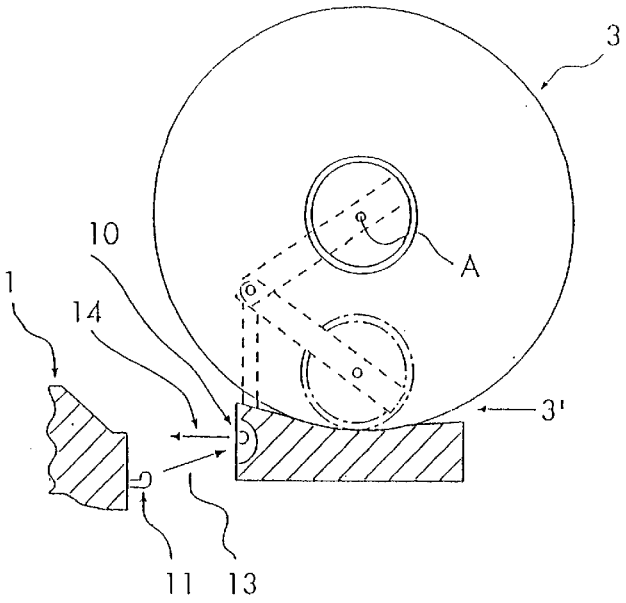
FIG. 3 shows an exemplified embodiment of a pair of co-operating coupling means for a manipulator and a roll support.

FIG. 3 shows a roll support (carrying a roll or full: denominated with reference number 3 and shown in unbroken lines; without roll or empty: denominated with reference number 3' and shown in broken lines) in a section perpendicular to the winding axis A and it also shows part of a manipulator 1. The support comprises a holding rod 10 functioning as support-coupling-means and the manipulator comprises hooks 11 functioning as manipulator-coupling-means 2 and being adapted to the holding rod 10. For coupling the hooks 11 to the holding rod 10, the manipulator 1 is approached in the direction of arrow 13 and for withdrawal with a coupled roll support 3 or 3' the manipulator is moved in the direction of arrow 14.

Figure 4:
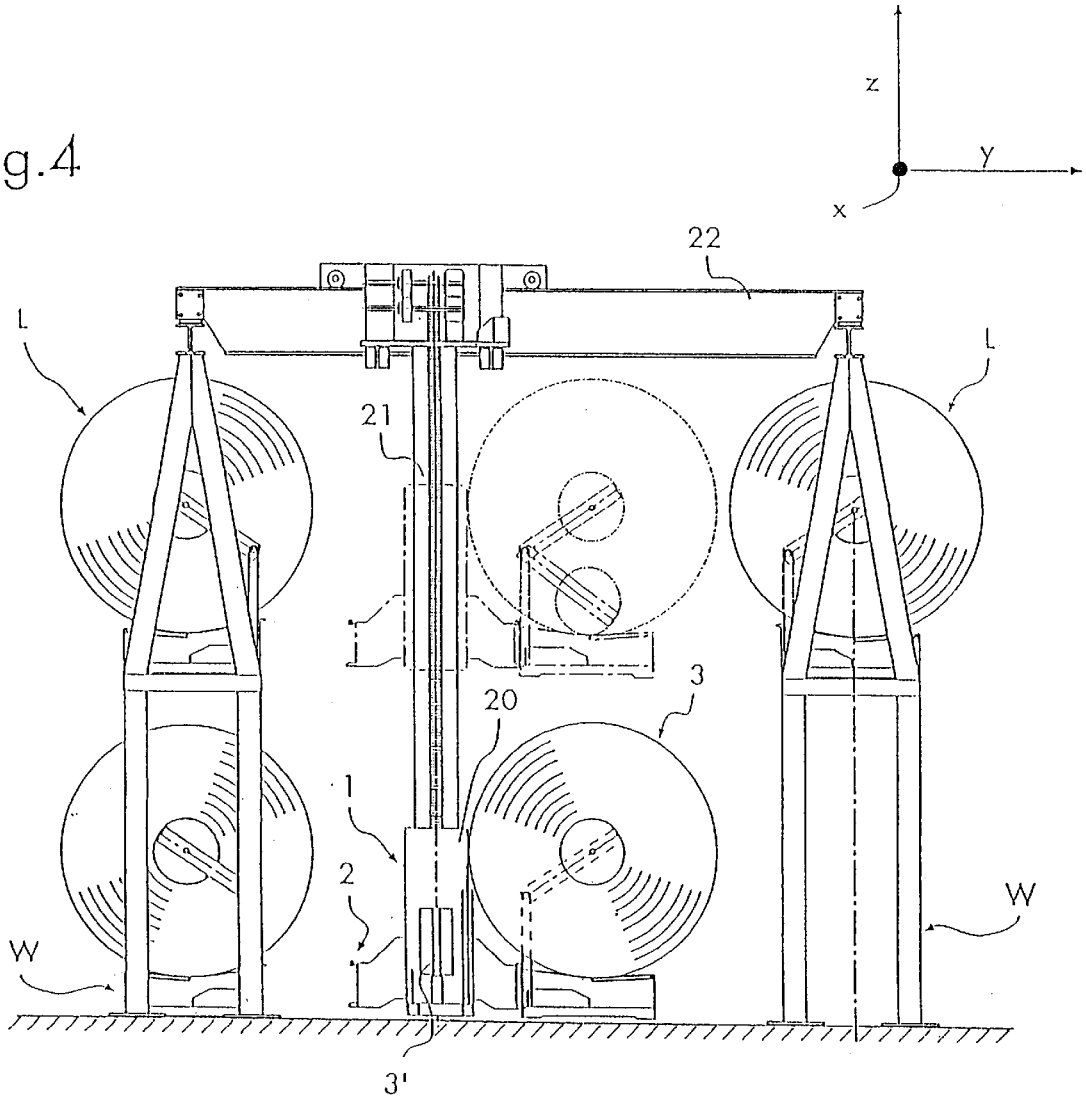
FIG. 4 shows an exemplified embodiment of the inventive device.

FIG. 4 shows an exemplified embodiment of a manipulator 1. It is designed as a travelling trolley 20 movable in z-direction along a column 21. The column 21 is carried by a supporting beam 22 and it is movable in y-direction along the supporting beam 22, the supporting beam itself being movable in x-direction. The travelling trolley 20 comprises four coupling means 2, whereby a full roll support 3 according to FIG. 2 is coupled to one of them and at an angle of 90° an empty, identical roll support 3' is coupled to it. The travelling trolley 20 is rotatable in relation to the supporting column 21 or it sits on the supporting column 22 secured against rotation whereby the column is rotatable in relation to the supporting beam 22. The column may be designed hanging on the supporting beam or it may be supported on the floor on suitable rollers.

FIG. 4 shows two opposite winding stations and two storage positions L arranged above the winding stations, winding stations and storage positions being served by the inventive device. In order to, e.g. replace a full roll in a winding station with an empty one and then to exchange the full one with an empty one in an opposite storage position, the following course of movements is necessary: approaching winding station (x, y, z) and coupling, removing (y), rotating, introducing (y), de-coupling and withdrawing (x, y, z), approaching storage position (x, y, z) and coupling, removing (y), rotating, introducing (y), de-coupling and withdrawing (x, y, z). As the manipulator 1 comprises four coupling means 2 rotation between the withdrawing from a winding station (or storage position) and the approaching of an opposite storage position (or winding station) becomes unnecessary.

Figure 5:
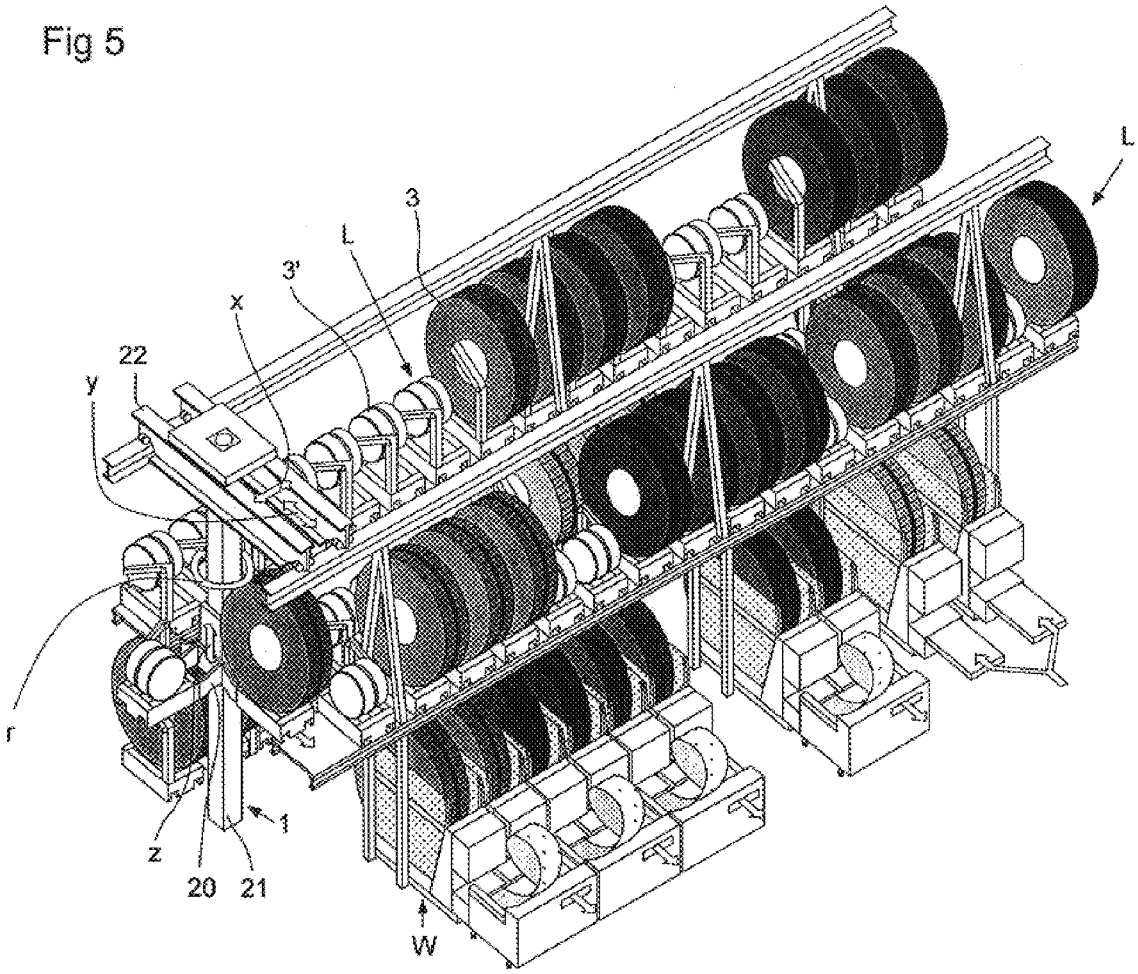
FIG. 5 shows an arrangement of winding stations and storage positions for roll supports served by at least one inventive device according to FIG. 4.

FIG. 5 finally shows an installation with winding stations W, of which the four left ones are designed as unwinding stations and the two right ones as winding-up stations, and with storage positions L for full and empty roll supports 3 and 3' arranged in a similar manner as shown in FIG. 4.

The winding stations W and the storage positions L are served with roll supports 3 and 3' by an embodiment of the inventive device according to FIG. 4. The manipulator 1 comprises a trolley 20 being movable in vertical direction (z) on a column 21 and comprising four coupling means, whereby the column 21 is rotatable (r) around its own axis and is movable in y-direction along a supporting beam 22 which itself is movable in x-direction.

What is claimed is:

1. Device for manipulation and transport of roll supports (3, 3'), in particular for exchanging roll supports (3, 3') in roll support-receiving stations selected from among winding stations (W) and storage positions (L), wherein each roll support comprises a winding core mounted with a horizontal winding axis (A) and a front and a rear narrow side which narrow sides are substantially parallel to the winding axis (A), and wherein the roll supports (3, 3') are introduceable into the roll support-receiving stations and removable from the roll support-receiving stations with their front narrow sides oriented towards the roll support-receiving stations, characterized in that the device comprises at, least one manipulator (1) equipped with at least two manipulator coupling means (2) each designed for being coupled to a coupling means (2') arranged on the rear narrow side of each roll support (3, 3') and the at least two manipulator-coupling means being arranged with an angle of 90° between them in relation to a vertical rotation axis of the manipulator, wherein the manipulator is moveable in two horizontal directions (x, y) and in vertical direction (z) and is rotatable about the vertical rotation axis.

2. Device according to claim 1, characterized in that the rotatability of the manipulator (1) is restricted to steps of 90°.

3. Device according to claim 1, characterized in that the manipulator-coupling-means (2) comprises a plurality of hooks (11) and that the support-coupling-means (2') comprises a holding rod (10).

4. Device according to claim 1, characterized in that the manipulator-coupling-means (2) are arranged on a travelling trolley (20) which travelling trolley (20) is vertically movable on a column (21) and is rotatable around a vertical rotation axis relative to the column or together with the column (21), whereby the column (21) is horizontally movable on a horizontal supporting beam (22) and the horizontal supporting beam is arranged to be substantially horizontally movable in a direction perpendicular to its length.

5. Method for replacing a first roll support (3) positioned is a roll support-receiving station, selected from a winding station (W) and a storage position (L) by a second roll support (3')

wherein each roll support comprises a winding core mounted with a horizontal winding axis (A) and a front and a rear narrow side which narrow sides are substantially parallel to the winding axis (A), and wherein the roll supports (3, 3') are introduceable into the roll support-receiving stations and removable from the roll support-receiving stations with their front narrow sides oriented towards the roll support-receiving stations, wherein the method is performed using a device comprising at least one manipulator (1) equipped with at least two manipulator coupling means (2) each designed for being coupled to a coupling means (2') arranged on the rear narrow side of each roll support (3, 3') and the at least two manipulator-coupling means being arranged with an angle of 90° between them in relation to a vertical rotation axis of the manipulator, whereby the manipulator is moveable in two horizontal directions (x, y) and in vertical direction (z) and is rotatable about the vertical rotation axis; and wherein the method comprises the following steps:

approaching the manipulator (1) having the second role support (3') coupled to its first coupling means (2) to the roll support-receiving station and positioning it such that a second coupling means (2) of the manipulator (1) can be coupled to the first roll support (3) positioned in the roll support-receiving station and coupling the first roll support (3) to the manipulator, removing the first roll support (3) from the roll support-receiving station, rotating by 90° the manipulator (1) to which the first and second roll supports (3, 3') are coupled, introducing the second roll support (3') into the roll support-receiving station, and de-coupling the second roll support (3') from the first coupling means (2) of the manipulator (1) and withdrawing the manipulator (1) to which the first roll support (3) is coupled.

6. An arrangement comprising a plurality of winding stations (W) with entrances positions on two sides of an operation corridors, a plurality of storage positions (L), a plurality of roll supports (3, 3') each comprising a winding core mounted with a horizontal winding axis (A) and having a front and a rear narrow side which narrow sides are substantially parallel to the winding axis (A), the roll supports (3, 3') are introduceable into winding stations (W) and the storage positions (L) and removable from the winding stations (W) and the storage positions (L) with their front narrow sides oriented towards the winding stations (W) and the storage positions (L), and at least one device for manipulation and transport of roll supports, the device comprising at least one manipulator (1) equipped with at least two manipulator coupling means (2) each designed for being coupled to a coupling means (2') arranged on the rear narrow side of each roll support (3, 3') and the at least two manipulator-coupling means being arranged with an angle of 90° between them in relation to a vertical rotation axis of the manipulator, whereby the manipulator is moveable in two horizontal directions (x, y) and in vertical direction (z) and is rotatable about the vertical rotation axis.

7. Arrangement according to claim 6, characterized in that the winding stations (W) for winding-up are arranged on the one side of the operation corridor and the winding stations (W) for un-winding are arranged on the other side of the corridor such that scaled product streams supplied to winding stations for winding-up and the ones conveyed away from un-winding stations are conveyed in parallel and with the same orientation.

8. Arrangement according to claim 7, characterized in that the storage positions are arranged along wider operation corridors and narrower transport corridors, the corridors being arranged in two directions (x, y) perpendicular to each other.

9. Arrangement according to claim 6, characterized in that the storage positions are arranged along wider operation corridors and narrower transport corridors, the corridors being arranged in two directions (x, y) perpendicular to each other.

* * * * *